US006849160B2

(12) United States Patent
Rousseau

(10) Patent No.: US 6,849,160 B2
(45) Date of Patent: Feb. 1, 2005

(54) METHOD AND DEVICE FOR HEAT TREATMENT OF WASTE PRODUCTS

(75) Inventor: Louis Rousseau, Rochetaillee-sur Saone (FR)

(73) Assignee: Sanifa, Nanterre (FR)

( * ) Notice: Subject to any disclaimer, the term of this patent is extended or adjusted under 35 U.S.C. 154(b) by 0 days.

(21) Appl. No.: 09/284,690

(22) PCT Filed: Oct. 15, 1997

(86) PCT No.: PCT/FR97/01835

§ 371 (c)(1),
(2), (4) Date: Jul. 16, 1999

(87) PCT Pub. No.: WO98/16780

PCT Pub. Date: Apr. 23, 1998

(65) Prior Publication Data

US 2002/0117390 A1 Aug. 29, 2002

(30) Foreign Application Priority Data

Oct. 16, 1996 (FR) ..... 96 12845

(51) Int. Cl.[7] ..... C10B 1/10; F23K 3/00

(52) U.S. Cl. ..... 202/218; 202/131; 202/136; 202/249; 422/209; 110/226; 110/227; 110/246; 110/275; 110/276; 110/277

(58) Field of Search ..... 202/136, 218, 202/249, 131; 110/226, 227, 246, 275, 276, 277, 105; 422/209, 225

(56) References Cited

U.S. PATENT DOCUMENTS 3,682,117 A * 8/1972 Rousseau ..... 110/216
3,771,471 A * 11/1973 Du Chambon ..... 110/240
3,847,095 A * 11/1974 Bauer et al. ..... 110/246
3,882,801 A * 5/1975 Bolle ..... 110/240
3,916,806 A * 11/1975 Giraud ..... 110/203
4,060,042 A * 11/1977 Baraldi et al. ..... 110/14
4,859,177 A 8/1989 Kreisberg et al. ..... 432/14
6,279,492 B1 * 8/2001 Larson et al. ..... 110/346

FOREIGN PATENT DOCUMENTS

| | | |
|---|---|---|
| DE | 41 36 438 A1 | 6/1993 |
| EP | 0 224 999 | 9/1986 |
| EP | 0 564 365 A1 | 4/1993 |
| FR | 2 273 236 | 12/1975 |
| GB | 376491 | 7/1932 |
| WO | 88/02284 | 4/1988 |

* cited by examiner

*Primary Examiner*—Alexa Doroshenk
(74) *Attorney, Agent, or Firm*—Westerman, Hattori, Daniels & Adrian LLP

(57) ABSTRACT

An apparatus and method are for the pyrolysis of waste. The aparatus has a rotating cell formed of a cylinder in combination with a truncated cone rotating on the same axis. The apparatus also has a hopper for charging the waste at one end of the cylinder, an ash box at the other end of the cylinder, a gas recuperator, and a retaining threshold between the cylinder and the truncated cone. A region of intimate contact of the waste with itself is created, whereby the waste is converted into coke which is used as fuel in the pyrolysis of the waste.

12 Claims, 1 Drawing Sheet

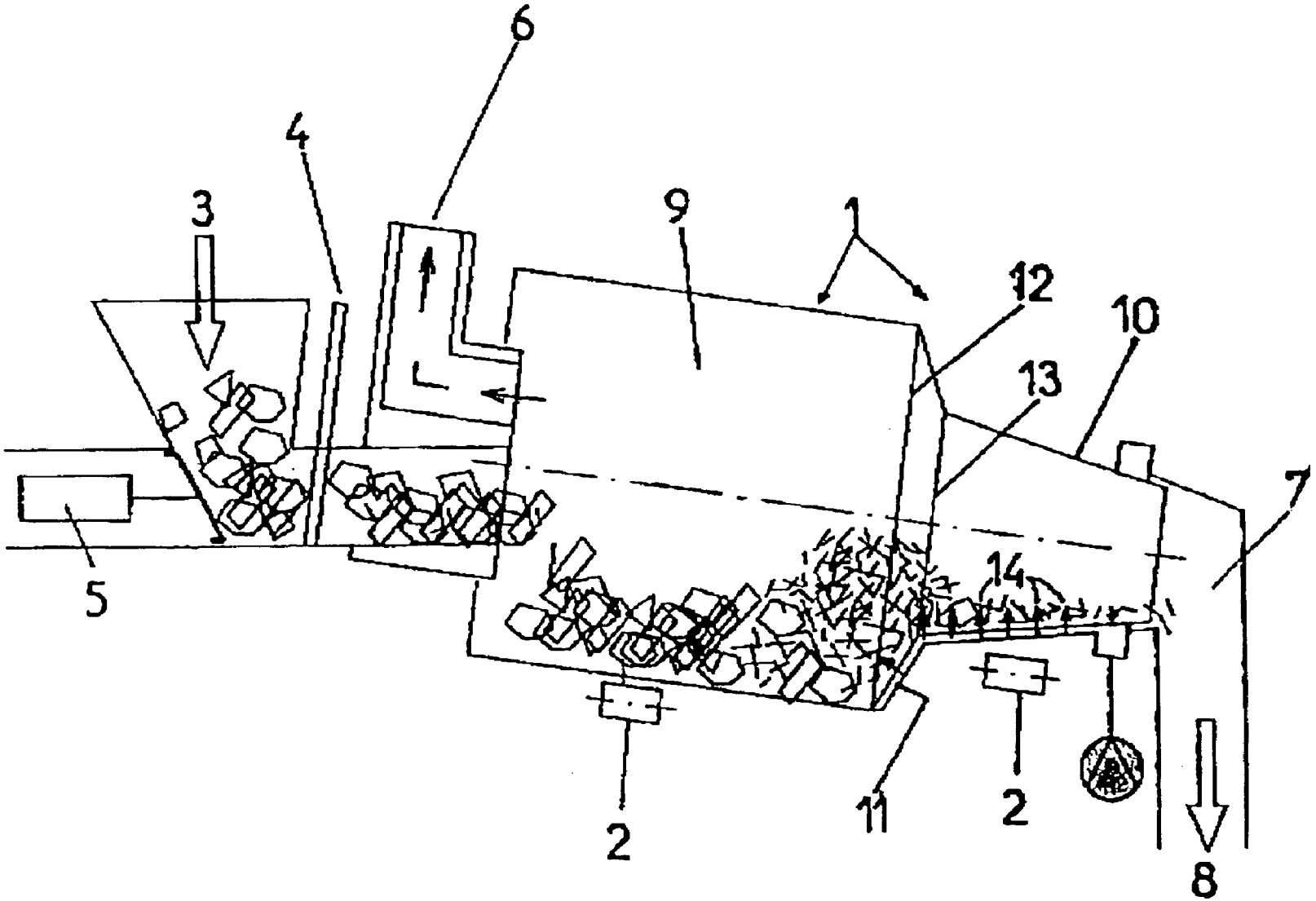
1
2
2
3
4
5
6
7
8
9
10
11
12
13
14

METHOD AND DEVICE FOR HEAT TREATMENT OF WASTE PRODUCTS

This is the U.S. national phase under 35 U.S.C. § 371 of International Application PCT/FR97/01835, filed Oct. 15, 1997.

The subject-matter of the present invention is a process for the heat treatment of waste, in particular, but not exclusively, domestic and industrial waste, and the plant for its implementation, of the type comprising a rotating combustion cell into which the waste is introduced via a charging end, whereas the slag is collected at the other end, while the gases are recovered upstream or downstream of the cell.

Currently, in this type of rotary kiln, the waste is combusted exothermally by introducing oxidizing air, the effect of which is to bring combustion of all the hydrocarbonaceous materials present in the waste to completion, the stirring of which, during its displacement towards the ash box, is provided by the rotation of the cylindrical and/or conical combustion chamber.

At this stage in the combustion, the gases are 99% incinerated and the clinker has a content of uncombusted material of 2 to 10% in the form of carbon.

The reduction by oxidation of virtually all the hydrocarbonaceous material is reflected by high temperatures of more than 1200° C. for waste with a mean net calorific value (NCV) of 2000 kcal/kg, which temperatures can reach more than 1400° C. with waste with an NCV of 3500 kcal/kg and more.

These high temperatures result in the following phenomena:

1—The dust, suspended by the forced aeration of the waste which is found in the fumes, melts and is deposited on the walls of the kiln and of the boiler.

2—The clinker is also molten and agglomerates on the walls.

To avoid these phenomena, there exists only one solution, to introduce excess air, which air does not participate in the combustion but has the role of moderating the combustion temperatures to approximately 850–900° C.

However, this excess air exhibits the following disadvantages:

1—It requires energy in order to be produced and extracted.

2—The volume of fumes generated is greater and requires gas lines with greater cross sections and volumes.

3—The toxic and polluting components which are found in the waste are virtually completely entrained in the fumes and require a larger-volume and more complex device in order to scavenge them.

4—International regulations, which are increasingly restrictive, lay down temperatures for the combustion of fumes which are greater than 1150° C. and very low contents of pollutants and dust, which are more particularly generated by combustion with excess air.

5—The fumes produced at 900° C. only make possible an efficiency of 60 to 65% for heat recovery, whereas it is desirable to achieve 80 to 85%.

6—In a combustion chamber operating with excess air, it is very difficult, if not impossible, to bring under control the energy contribution supplied by waste with an NCV of greater than 3500 kcal/kg.

To overcome these disadvantages, a novel heat treatment process has been devised, using pyrolysis, which makes it possible, in the absence of oxygen, to distil all the waste at a low temperature of the order of 600 to 700° C., whatever its NCV.

This novel process is also targeted at producing fuel gases, rich in CO, $CH_4$ or various tars, which are incinerated at 1200° C. under spontaneous combustion in a specific chamber. These gases, which only have a slight load of pollutants because of the low temperatures, require a treatment which is markedly less complex and which is markedly smaller in scale than the incineration.

To implement this process, the plant comprises a rotating cell composed of a cylinder and of a truncated cone rotating on the same axis.

Pyrolysis is carried out in the cylindrical part of the cell and, as it is energy-intensive, energy is supplied by the coke produced by itself, the combustion of which takes place in the truncated cone, defined as being the generator of heat for the pyrolysis. The thermal reduction, pyrolysis/combustion of the coke, takes place countercurrentwise, the gases produced moving countercurrentwise to the solids.

To allow pyrolysis, it is necessary to have available in the cell a region in which the waste in the course of distillation is heated by the thermal energy originating from the above-mentioned generator. At a certain stage in its heating, the waste needs to be brought into prolonged intimate contact with itself in order to be converted into coke.

The fundamental characteristic of the plant for the heat treatment of waste in question lies essentially in the fact that it comprises this region of intimate contact of the waste with itself determined by a retaining threshold lying between the cylindrical part and the frustoconical part of the rotating cell.

This is because the waste in the course of coking is forced, in crossing this threshold, to form a volume in which the constituents are brought mutually into close contact while receiving a small amount of oxygen. At this instant, the reaction temperature of the waste rises to approximately 700° C. This retaining of the waste, artificially created by the threshold, makes it possible to obtain a coke which is used in the generator cone as fuel to provide the hot gas flow necessary for the pyrolysis.

In this cone, in a known way, the combustion air is distributed under the ignited coke by a network of nozzles fed via channels.

BRIEF DESCRIPTION OF THE DRAWING

The invention is described below with the help of an example and of references to the appended drawing, in which:

The single FIGURE is a diagrammatic view of the plant for the heat treatment of waste according to the invention.

In the drawing, the indicator 1 denotes the rotating cell driven in rotation by mechanical means represented diagrammatically by the references 2.

Upstream of the cell 1, the arrow 3 denotes the hopper for charging waste, equipped with a flap 4 and a pushing device 5.

The chimney for recovering the pyrolysis gases is denoted by the indicator 6.

An ash box 7 for discharge of the slag or of the coke, symbolized by the arrow 8, is positioned downstream of the cell 1.

It is obvious that the fittings and other devices, such as the charging hopper, the recovery chimney, indeed even the ash box, are known components which are chosen according to the results to be obtained.

The rotating cell 1 is composed, according to the invention, of a cylindrical part 9, constituting the pyrolyser, in combination with a frustoconical part 10, forming the generator. Between the cylinder 9 and the truncated cone 10 lies a region 11 connecting the end 12 of the cylinder 9 and the large base 13 of the truncated cone 10. This region 11 constitutes a retaining threshold for the waste assuming a high conicity resulting from the difference in diameter between the cylinder 9 and the truncated cone 10.

A network of nozzles fed via distribution channels with combustion air is provided in the frustoconical part 10. Arrows 14 symbolize this air supply.

It is found that, by virtue of this plant for the treatment of solid waste with an NCV ranging from 1500 to 10,000 kcal/kg, the following are obtained:

the production of a pyrolysis gas with an NCV of 900 to 1100 kcal/$Nm^3$ which gas is only slightly polluted and has a high degree of enhanced value, which is carried out under the best conditions.

compliance with the strictest antipollution standards with reduced means.

a substantial reduction in the size and the cost of the installations.

What is claimed is:

1. An apparatus for the pyrolysis of waste, comprising:

a rotating cell formed of a cylinder, said cylinder having a diameter and two ends, in combination with a truncated cone rotating on the same axis, said truncated cone having a large base and a small base, said large base and said small base each having a diameter, the diameter of said cylinder being larger than the diameter of said large base of said truncated cone, and a region extending between said large base of said truncated cone and said end of said cylinder which is adjacent to said large base of said truncated cone, said region forming a retaining threshold resulting from a difference between the diameter of the cylinder and the diameter of the large base of the truncated cone and creating a region of intimate contact of the waste with itself whereby the waste is converted into coke which is used in the truncated cone as fuel for pyrolysis of the waste, wherein a main longitudinal axis of the rotating cell is inclined with respect to the horizontal.

2. The apparatus of claim 1, further comprising a hopper for charging the waste at one end of said cell, an ash box at the other end of said cell, and a recovery chimney, in connection with said cell, for recovering gases from said cell.

3. The apparatus according to claim 2, wherein the truncated cone further comprises a network of nozzles fed via channels distributing combustion air in a substoichiometric amount, thereby combusting the coke which is used as fuel in the pyrolysis of the waste.

4. The apparatus according to claim 2, wherein said region comprises a conical section positioned between said cylinder and said truncated cone.

5. The apparatus according to claim 1, wherein said region comprises a conical section positioned between said cylinder and said truncated cone.

6. An apparatus for the pyrolysis of waste, comprising:

a rotating cell formed of a cylinder, said cylinder having a diameter and two ends, in combination with a truncated cone rotating on the same axis, said truncated cone having a large base and a small base, said large base and said small base each having a diameter, the diameter of said cylinder being larger than the diameter of said large base of said truncated cone, and a region extending between said large base of said truncated cone and said end of said cylinder which is adjacent to said large base of said truncated cone, said region forming a retaining threshold resulting from a difference between the diameter of the cylinder and the diameter of the large base of the truncated cone and creating a region of intimate contact of the waste with itself whereby the waste is converted into coke which is used in the truncated cone as fuel for pyrolysis of the waste, wherein the truncated cone further comprises a network of nozzles fed via channels distributing combustion air in a substochiometric amount, thereby combusting the coke which is used as fuel in the pyrolysis of the waste.

7. The apparatus according to claim 6, further comprising a hopper for charging the waste at one end of said cell, an ash box at the other end of said cell, and a recovery chimney, in connection with said cell, for recovering gases from said cell.

8. The apparatus according to claim 6, wherein a main longitudinal axis of the rotating cell is inclined with respect to the horizontal.

9. An apparatus for the pyrolysis of waste, comprising:

a rotating cell formed of a cylinder, said cylinder having a diameter and two ends, in combination with a truncated cone rotating on the same axis, said truncated cone having a large base and a small base, said large base and said small base each having a diameter, the diameter of said cylinder being larger than the diameter of said large base of said truncated cone, and a region extending between said large base of said truncated cone and said end of said cylinder which is adjacent to said large base of said truncated cone, said region forming a retaining threshold resulting from a difference between the diameter of the cylinder and the diameter of the large base of the truncated cone and creating a region of intimate contact of the waste with itself whereby the waste is converted into coke which is used in the truncated cone as fuel for pyrolysis of the waste, wherein a recovery chimney is placed on the cylinder in the rotating cell.

10. The apparatus according to claim 9, further comprising a hopper for charging the waste at one end of said cell, an ash box at the other end of said cell, and the recovery chimney, in connection with said cell, for recovering gases from said cell.

11. An apparatus for the pyrolysis of waste, comprising:

a rotating cell formed of a cylinder, said cylinder having a diameter and two ends, in combination with a truncated cone rotating on the same axis, said truncated cone having a large base and a small base, said large base and said small base each having a diameter, the diameter of said cylinder being larger than the diameter of said large base of said truncated cone, and a region extending between said large base of said truncated cone and said end of said cylinder which is adjacent to said large base of said truncated cone, said region forming a retaining threshold resulting from a difference between the diameter of the cylinder and the diameter of the large base of the truncated cone and creating a region of intimate contact of the waste with itself whereby the waste is converted into coke which is used in the truncated cone as fuel for pyrolysis of the waste, wherein the truncated cone further comprises a network of combustion air-distribution nozzles.

12. The apparatus according to claim 11, further comprising a hopper for charging the waste at one end of said cell, an ash box at the other end of said cell, and a recovery chimney, in connection with said cell, for recovering gases from said cell.

* * * * *